US006950034B2

(12) United States Patent
Pacault et al.

(10) Patent No.: US 6,950,034 B2
(45) Date of Patent: Sep. 27, 2005

(54) METHOD AND APPARATUS FOR PERFORMING DIAGNOSTICS ON A DOWNHOLE COMMUNICATION SYSTEM

(75) Inventors: Nicolas Pacault, Houston, TX (US); Bruce W. Boyle, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 198 days.

(21) Appl. No.: 10/604,986

(22) Filed: Aug. 29, 2003

(65) Prior Publication Data

US 2005/0046591 A1 Mar. 3, 2005

(51) Int. Cl.[7] ..... G06F 19/00
(52) U.S. Cl. ..... 340/855.2; 702/1
(58) Field of Search ..... 701/1; 367/13; 73/40, 152; 340/854, 855, 853; 166/385; 439/577

(56) References Cited

U.S. PATENT DOCUMENTS

| | | | |
|---|---|---|---|
| 2,379,800 A | 7/1945 | Hare | 336/105 |
| 2,414,719 A | 1/1947 | Cloud | 333/177 |
| 3,079,549 A | 2/1963 | Martin | 324/323 |
| 3,090,031 A | 5/1963 | Lord | 340/854.8 |
| 3,387,606 A | 6/1968 | Crafts et al. | 128/202.27 |
| 3,682,098 A | 8/1972 | Spies | 102/206 |
| 3,696,332 A | 10/1972 | Dickson, Jr. et al. | 340/855.1 |
| 3,807,502 A | 4/1974 | Heilhecker et al. | 166/385 |
| 3,879,097 A | 4/1975 | Oertke | 340/855.1 |
| 3,918,537 A | 11/1975 | Heilhecker | 175/320 |
| 3,957,118 A | 5/1976 | Barry et al. | 166/385 |
| 3,995,209 A | 11/1976 | Weston | 323/355 |

(Continued)

FOREIGN PATENT DOCUMENTS

| | | |
|---|---|---|
| EP | 1 158 138 A2 | 11/2001 |
| GB | 2 190 410 A | 11/1987 |
| GB | 2 363 554 | 12/2001 |
| GB | 2 363 641 A | 1/2002 |
| GB | 2 370 590 A | 7/2002 |
| RU | 2040691 C1 | 2/1992 |
| RU | 2140537 C1 | 12/1997 |
| WO | WO 90/14497 | 11/1990 |
| WO | WO 02/06716 | 1/2002 |

OTHER PUBLICATIONS

US Dep't of Energy press release, *DOE Techline*, "DOE Selects California Small Business to Help Develop 'Smart Drilling System' for Oil & Natural Gass", http:www.netl.doe.gov/publications/press/1999/tl_smartdrill.html (Oct. 13, 1999).

(Continued)

*Primary Examiner*—John Barlow
*Assistant Examiner*—Victor J. Taylor
(74) *Attorney, Agent, or Firm*—Jennie Salazar; Victor H. Segura; Dale Gaudier

(57) ABSTRACT

A method for performing diagnostics on a wired drill pipe telemetry system of a downhole drilling system is provided. The method includes passing a signal through a plurality of drill pipe in the wired drill pipe (WDP) telemetry system, receiving the signal from the WDP telemetry system, measuring parameters of the received signal and comparing characteristics of the received signal parameters against a known reference to identify variations therein whereby a fault in the wired drill pipe telemetry system is identified. The signal, in the form of a waveform or a pulse, is passed through the WDP telemetry system. The impedance and/or time delay of the received signal is measured. By analyzing variations, such as resonance and/or reflections in the signal, the existence and/or location of a fault in the WDP telemetry system may be determined.

28 Claims, 15 Drawing Sheets

U.S. PATENT DOCUMENTS

| | | | | |
|---|---|---|---|---|
| 4,012,092 | A | 3/1977 | Godbey et al. | 439/191 |
| 4,038,625 | A | 7/1977 | Tompkins et al. | 336/83 |
| 4,057,781 | A | 11/1977 | Scherbatskoy | 340/854.4 |
| 4,126,848 | A | 11/1978 | Denison | 340/855.1 |
| 4,176,894 | A | 12/1979 | Godbey | 439/194 |
| 4,193,227 | A | 3/1980 | Uhtenwoldt | 451/5 |
| 4,202,490 | A | 5/1980 | Gunkel et al. | 235/449 |
| 4,215,426 | A | 7/1980 | Klatt | 367/83 |
| 4,220,381 | A | 9/1980 | Van der Graaf | 340/853.7 |
| 4,276,619 | A | 6/1981 | Rickenbacker | 367/13 |
| 4,348,672 | A | 9/1982 | Givler | 340/854.8 |
| 4,388,524 | A | 6/1983 | Walton | 235/380 |
| 4,445,734 | A | 5/1984 | Cunningham | 439/194 |
| 4,497,029 | A | 1/1985 | Kiyokawa | 700/175 |
| 4,533,823 | A | 8/1985 | Vittorio | 235/375 |
| 4,569,421 | A | 2/1986 | Sandstedt | 186/39 |
| 4,578,675 | A | 3/1986 | MacLeod | 340/853.7 |
| 4,578,991 | A | 4/1986 | Nowlin | 73/152.43 |
| 4,605,268 | A | 8/1986 | Meador | 439/194 |
| 4,628,458 | A | 12/1986 | Ohta et al. | 700/175 |
| 4,675,638 | A | 6/1987 | Szabo | 336/83 |
| 4,698,631 | A | 10/1987 | Kelly, Jr. et al. | 340/853.1 |
| 4,720,626 | A | 1/1988 | Nishikawa et al. | 235/449 |
| 4,742,470 | A | 5/1988 | Juengel | 700/175 |
| 4,745,557 | A | 5/1988 | Pekar et al. | 700/188 |
| 4,780,599 | A | 10/1988 | Baus | 235/383 |
| 4,806,928 | A | 2/1989 | Veneruso | 340/853.3 |
| 4,818,855 | A | 4/1989 | Mongeon et al. | 235/440 |
| 4,845,093 | A | 7/1989 | Haga et al. | 514/247 |
| 4,850,009 | A | 7/1989 | Zook et al. | 379/93.17 |
| 4,901,069 | A | 2/1990 | Veneruso | 340/854.8 |
| 4,914,433 | A | 4/1990 | Galle | 340/854.4 |
| 4,928,088 | A | 5/1990 | Jorion et al. | 340/854.7 |
| 5,005,763 | A | 4/1991 | Cullen et al. | 340/854 |
| 5,050,675 | A | 9/1991 | Upchurch | 166/373 |
| 5,052,941 | A | 10/1991 | Hernandez-Marti et al. | 439/194 |
| 5,142,128 | A | 8/1992 | Perkin et al. | 235/375 |
| 5,196,418 | A | 3/1993 | Gandour et al. | 514/230.8 |
| 5,202,680 | A | 4/1993 | Savage | 340/853.8 |
| 5,255,739 | A | 10/1993 | Neuroth et al. | 166/65.1 |
| 5,278,550 | A | 1/1994 | Rhein-Knudsen et al. | 340/855.1 |
| 5,360,967 | A | 11/1994 | Perkin et al. | 235/375 |
| 5,384,288 | A | 1/1995 | Ying | 438/431 |
| 5,455,573 | A | 10/1995 | Delatorre | 340/853.8 |
| 5,480,041 | A | 1/1996 | Turner | 212/273 |
| 5,521,952 | A | 5/1996 | Morishima | 377/55 |
| 5,616,322 | A | 4/1997 | Niwa et al. | 424/192.1 |
| 5,905,194 | A | 5/1999 | Strong | 73/40.5 R |
| 5,971,072 | A | 10/1999 | Huber et al. | 166/297 |
| 6,011,346 | A | 1/2000 | Buchanan et al. | 310/339 |
| 6,075,461 | A | 6/2000 | Smith | 340/853.7 |
| 6,333,699 | B1 | 12/2001 | Zierolf | 340/854.8 |
| 6,445,307 | B1 | 9/2002 | Rassi et al. | 340/854.6 |
| 6,480,811 | B2 | 11/2002 | Denny et al. | 702/188 |
| 6,597,945 | B2 | 7/2003 | Marksteiner | 600/547 |
| 2001/0054969 | A1 | 12/2001 | Thomeer et al. | 340/853.3 |
| 2002/0014966 | A1 | 2/2002 | Strassner, II et al. | 340/572.1 |
| 2002/0039328 | A1 | 4/2002 | Dubinsky | 367/82 |
| 2002/0050930 | A1 | 5/2002 | Thomeer et al. | 340/853.3 |
| 2002/0066309 | A1 * | 6/2002 | Tubel et al. | 73/152.54 |
| 2002/0093431 | A1 | 7/2002 | Zierolf | 340/854.1 |
| 2002/0112852 | A1 | 8/2002 | Floerke et al. | 166/65.1 |
| 2002/0193004 | A1 * | 12/2002 | Boyle et al. | 439/577 |

OTHER PUBLICATIONS

US Dep't of Energy, *ACPT* Year–end Review Meeting and Continuation Application Review, "Cost Effective Composite Drill Pipe," Slide 25 (Aug. 31, 2000).

Hall, David R., Novatek Engineering Inc., "Telemetry Drill Pipe" (No Date).

McDonald, Wm, J., *Offshore*, "Four Basic Systems will be Offered," pp. 96–103 (Dec. 1977).

McDonald, Wm. J., *Oil & Gas Journal*, "Four Different Systems used for MWD," pp. 115–124 (Apr. 1978).

* cited by examiner

METHOD AND APPARATUS FOR PERFORMING DIAGNOSTICS ON A DOWNHOLE COMMUNICATION SYSTEM

BACKGROUND OF INVENTION

The invention relates generally to drill string telemetry. More specifically, the invention relates to wired drill pipe telemetry systems and techniques for identifying failures therein.

BACKGROUND ART

Downhole systems, such as Measurement While Drilling (MWD) and Logging While Drilling (LWD) systems, derive much of their value from their abilities to provide real-time information about borehole conditions and/or formation properties. These downhole measurements may be used to make decisions during the drilling process or to take advantage of sophisticated drilling techniques, such as geosteering. These techniques rely heavily on instantaneous knowledge of the formation that is being drilled. Therefore, it is important to be able to send large amounts of data from the MWD/LWD tool to the surface and to send commands from surface to the MWD/LWD tools. A number of telemetry techniques have been developed for such communications, including wired drill pipe (WDP) telemetry.

The idea of putting a conductive wire in a drill string has been around for some time. For example, U.S. Pat. No. 4,126,848 issued to Denison discloses a drill string telemeter system, wherein a wireline is used to transmit the information from the bottom of the borehole to an intermediate position in the drill string, and a special drilling string, having an insulated electrical conductor, is used to transmit the information from the intermediate position to the surface. Similarly, U.S. Pat. No. 3,957,118 issued to Barry et al. discloses a cable system for wellbore telemetry, and U.S. Pat. No. 3,807,502 issued to Heilhecker et al. discloses methods for installing an electric conductor in a drill string. PCT Patent Application No. WO 02/06716 to Hall discloses a system for transmitting data through a string of down-hole components using a magnetic coupler.

For downhole drilling operations, a large number of drill pipes are used to form a chain between the surface Kelley (or top drive) and a drilling tool with a drill bit. For example, a 15,000 ft (5472 m) well will typically have 500 drill pipes if each of the drill pipes is 30 ft (9.14 m) long. In wired drill pipe operations, some or all of the drill pipes may be provided with conductive wires to form a wired drill pipe ("WDP") and provide a telemetry link between the surface and the drilling tool. With 500 drill pipes, there 500 joints, each of which may include inductive couplers such as toroidal transformers. The sheer number of connections in a drill string raises concerns of reliability for the system. A commercial drilling system is expected to have a minimum mean time between failure (MTBF) of about 500 hours or more. If one of the wired connections in the drill string fails, then the entire telemetry system fails. Therefore, where there are 500 wired drill pipes in a 15,000 ft (5472 m) well, each wired drill pipe should have an MTBF of at least about 250,000 hr (28.5 yr) in order for the entire system to have an MTBF of 500 hr. This means that each WDP should have a failure rate of less than $4\times10^{-6}$ per hr. This requirement is beyond the current WDP technology. Therefore, it is necessary that methods are available for testing the reliability of a WDP and for quickly identifying any failure.

Currently, there are few tests that can be performed to ensure WDP reliability. Before the WDP are brought onto the rig floor, these pipes may be visually inspected and the pin and box connections of the pipes may be tested for electrical continuity using test boxes. It is possible that two WDP sections may pass a continuity test individually, but they might fail when they are connected together. Such failures might, for example result from debris in the connection that damages the inductive coupler. Once the WDPs are connected (e.g., made up into triples), visual inspection of the pin and box connections and testing of electrical continuity using test boxes will be difficult, if not impossible, on the rig floor. This limits the utility of the currently available methods for WDP inspection.

In addition, the WDP telemetry link may suffer from intermittent failures that would be difficult to identify. For example, if the failure is due to shock, downhole pressure, or downhole temperature, then the faulty WDP section might recover when conditions change as drilling is stopped, or as the drill string is tripped out of the hole. This would make it extremely difficult, if not impossible, to locate the faulty WDP section.

In view of the above, it is desirable to have a diagnostic system capable of operating in connection with a WDP system. Additionally, it is also desirable that the system have techniques for identifying failures therein.

SUMMARY OF INVENTION

In one aspect, the present invention relates to a method for performing diagnostics on a wired drill pipe telemetry system downhole drilling system. The method comprises passing a signal through a plurality of drill pipe in the wired drill pipe telemetry system; receiving the signal from the wired drill pipe telemetry system; measuring parameters of the received signal; and comparing the received signal parameters against a known reference for variation thereof whereby a fault in the wired drill pipe telemetry system is identified.

The signal, in the form of a waveform or a pulse, is passed through the WDP telemetry system. The impedance and/or time delay of the received signal is measured. By comparing the characteristics of the received signal against a known reference, the existence and/or location of a fault in the WDP telemetry system may be determined. The ripples, reflections or other characteristics may determine the presence of a fault. If a fault is detected, the WDPs may be removed and the process repeated until the fault is located.

In another aspect, the invention relates to a method for performing diagnostics on a wired drill pipe telemetry system of a downhole drilling tool. The method comprises passing a signal through the wired drill pipe telemetry system; receiving the signal from the wired drill pipe telemetry system; measuring one of a voltage, a current and combination thereof of the received signal; determining the impedance of the received signal; and comparing the impedance of the received signal with the impedance of a known reference to identify a variation therefrom whereby a fault in the wired drill pipe telemetry system is identified.

In yet another aspect, the invention relates to a method for performing diagnostics on a wired drill pipe telemetry system of a downhole drilling tool. The method comprises passing a signal through the wired drill pipe telemetry system; receiving the signal from the wired drill pipe telemetry system, the signal received a time delay after the signal is passed; determining the time delay of the received signal; and comparing the time delay of the received signal against the time delay of a known reference to identify a variation therefrom whereby a fault in the wired drill pipe telemetry system is identified.

Finally in another aspect, the invention relates to a system for performing diagnostics on a wired drill pipe telemetry system of a downhole drilling tool. The wired drill pipe comprises a communication link. The system comprises a signal generator, a gauge and a processor. The signal generator is operatively connectable to the communication link of the wired drill pipe telemetry system and capable of passing a signal through the communication link. The gauge is operatively connectable to the communication link and is capable of receiving the signal from the wired drill pipe telemetry system and taking a measurement thereof. The processor is capable of comparing the received signal with a know reference to identify variations therefrom whereby a fault in the wired drill pipe telemetry system is detected. The gauge may be an oscilloscope and/or an impedance analyzer.

Other aspects of the invention will become apparent from the following description, the drawings, and the claims.

BRIEF DESCRIPTION OF DRAWINGS

FIGS. 6, 7, 8 and 9 are graphical depictions of complex impedance as a function of frequency in the WDP Telemetry system of FIG. 5 having 2, 20, 40 and 100 couplers, respectively.

FIGS. 10, 11, 12 and 13 are graphical depictions of the complex impedance of FIGS. 6, 7, 8 and 9, respectively, having a short therein.

FIGS. 14, 15, 16 and 17 are graphical depictions of the complex impedance of FIGS. 6, 7, 8 and 9, respectively, having a break therein.

DETAILED DESCRIPTION

Figure 1:
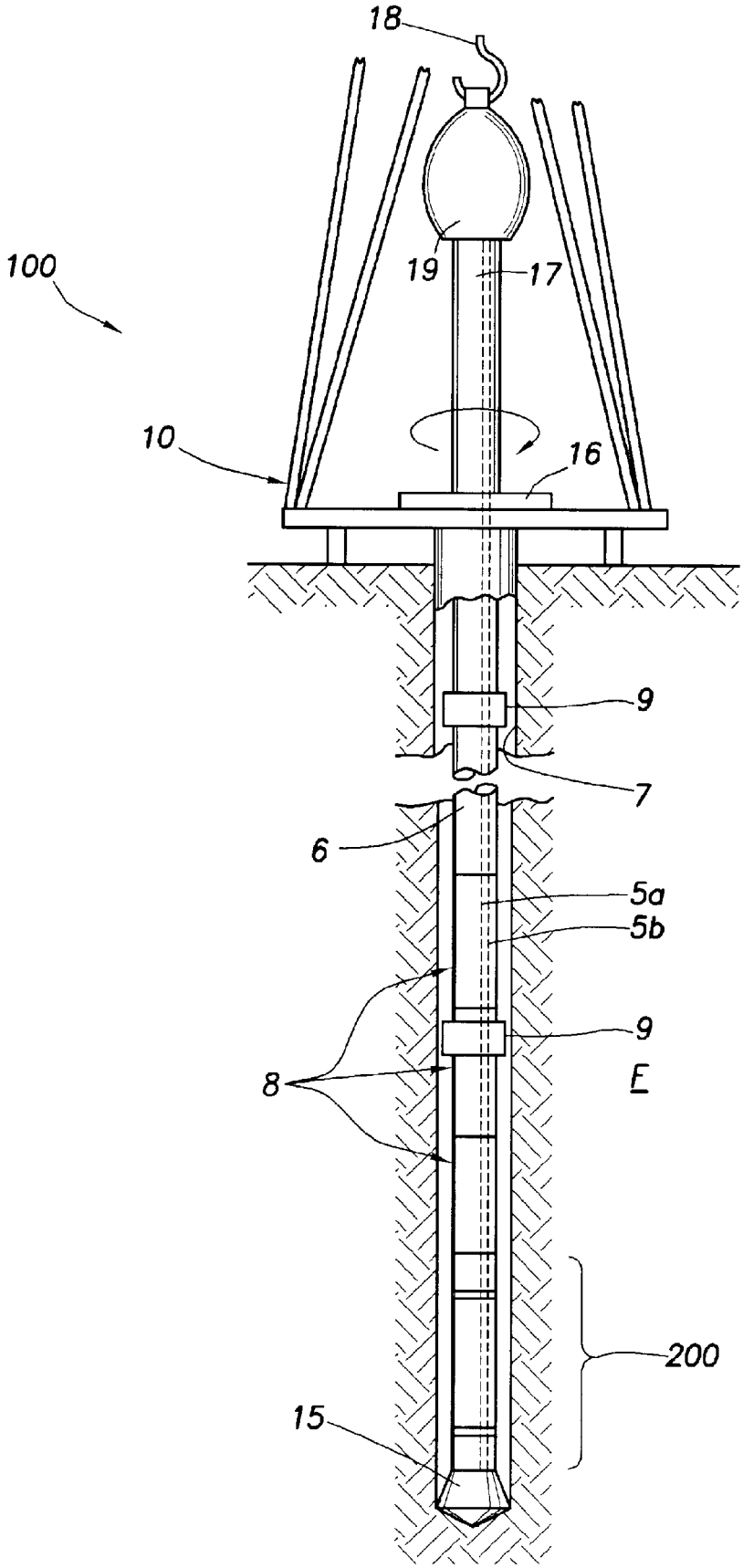
FIG. 1 shows a communication system for a downhole drilling tool disposed in a wellbore penetrating an earth formation.

Embodiments of the present invention relate to various techniques used in connection with Wired Drill Pipe (WDP). FIG. 1 illustrates a communication system 100 used in connection with a drilling rig and drill string. As shown in FIG. 1, a platform and derrick assembly 10 is positioned over wellbore 7 penetrating subsurface formation F. A drill string 6 is suspended within wellbore 7 and includes drill bit 15 at its lower end. Drill string 6 is rotated by rotary table 16, energized by means not shown, which engages kelly 17 at the upper end of the drill string. Drill string 6 is suspended from hook 18, attached to a traveling block (not shown), through kelly 17 and rotary swivel 19 which permits rotation of the drill string relative to the hook.

Drill string 6 further includes a bottom hole assembly (BHA) 200 disposed near the drill bit 15. BHA 200 may include capabilities for measuring, processing, and storing information, as well as communicating with the surface (e.g., MWD/LWD tools). An example of a communications apparatus that may be used in a BHA is described in detail in U.S. Pat. No. 5,339,037. A communication link 5 having dual conduits (5*a*, 5*b*) extends through the drill string 6 for communication between the downhole instruments and the surface. The communication system may comprise, among other things, a WDP telemetry system that comprises a plurality of WDPs 8. One or more repeaters 9 are preferably provided to re-amplify the signal through the WDP telemetry system.

One type of WDP, as disclosed in U.S. patent application Ser. No. 2002/0193004 by Boyle et al. and assigned to the assignee of the present invention, uses inductive couplers to transmit signals across pipe joints. An inductive coupler in the WDPs, according to Boyle et al., comprises a transformer that has a toroid core made of a high permeability, low loss material such as Supermalloy (which is a nickel-iron alloy processed for exceptionally high initial permeability and suitable for low level signal transformer applications). A winding, consisting of multiple turns of insulated wire, winds around the toroid core to form a toroid transformer. In one configuration, the toroidal transformer is potted in rubber or other insulating materials, and the assembled transformer is recessed into a groove located in the drill pipe connection.

Figure 2:
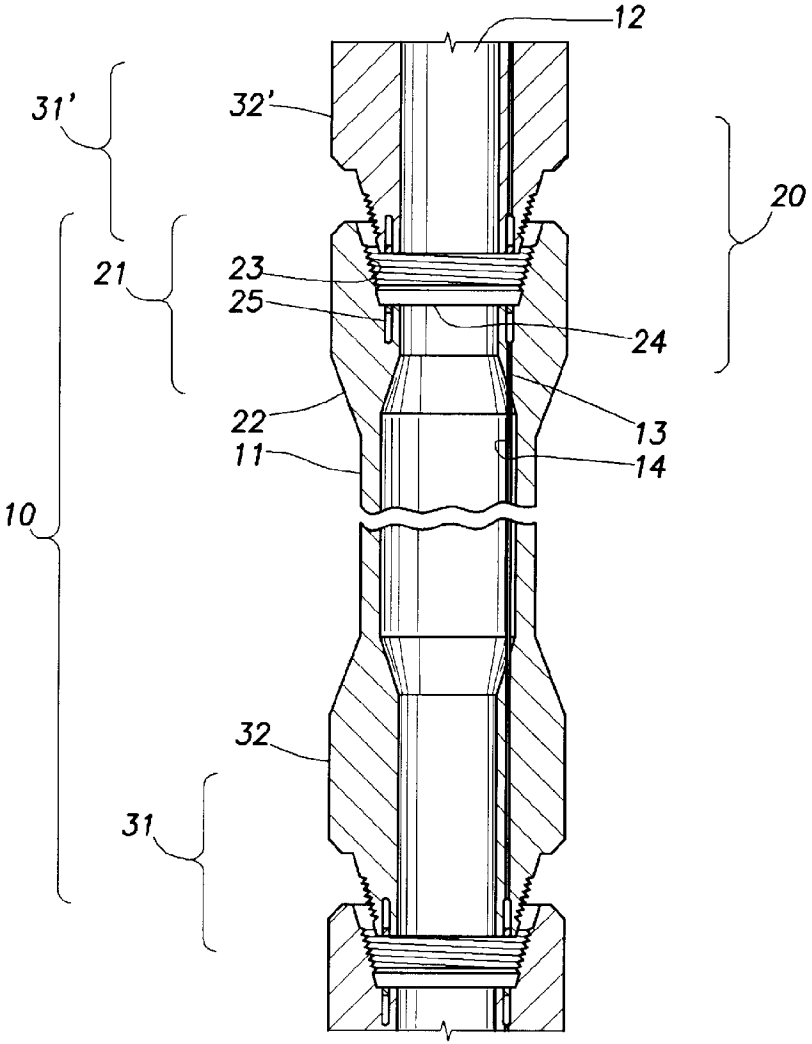
FIG. 2 shows a detailed view of the wired drill pipe of FIG. 1.

FIG. 2 shows an example of a WDP 10, as disclosed in the Boyle et al. application. In this example, the wired drill pipe 10 has a shank 11 having an axial bore 12, a box end 22, a pin end 32, and a wire 14 running from the box end 22 to the pin end 32. A first current-loop inductive coupler element 21 (e.g., a toroidal transformer) and a second current-loop inductive coupler element 31 are disposed at the box end 22 and the pin end 32, respectively. The first current-loop inductive coupler element 21, the second current-loop inductive coupler element 31, and the wire 14 within a single WDP form a "telemetry connection" in each WDP. Inductive coupler 20 (or "telemetry connection") at a pipe joint is shown as constituted by a first inductive coupler element 21 from one pipe and a second current-loop inductive coupler element 31' from the next pipe.

In this description, a "telemetry connection" or "coupler" defines a connection at a joint between two adjacent pipes, and a "telemetry section" refers to the telemetry components within a single piece of WDP. A "telemetry section" may include inductive coupler elements and the wire within a single WDP, as described above. However, in some embodiments, the inductive coupler elements may be replaced with some other device serving a similar function (e.g., direct electrical connections). When a plurality of such WDPs are made up into a drill string, the telemetry components are referred to as a "telemetry link." That is, a drill string "telemetry link" or a WDP "telemetry link" refers to an aggregate of a plurality of WDP "telemetry sections." When other components such as a surface computer, an MWD/LWD tool, and/or routers are added to a WDP "telemetry link," they are referred to as a "telemetry system." A surface computer as used herein may comprise a computer, a surface transceiver, and/or other components.

Figure 4:
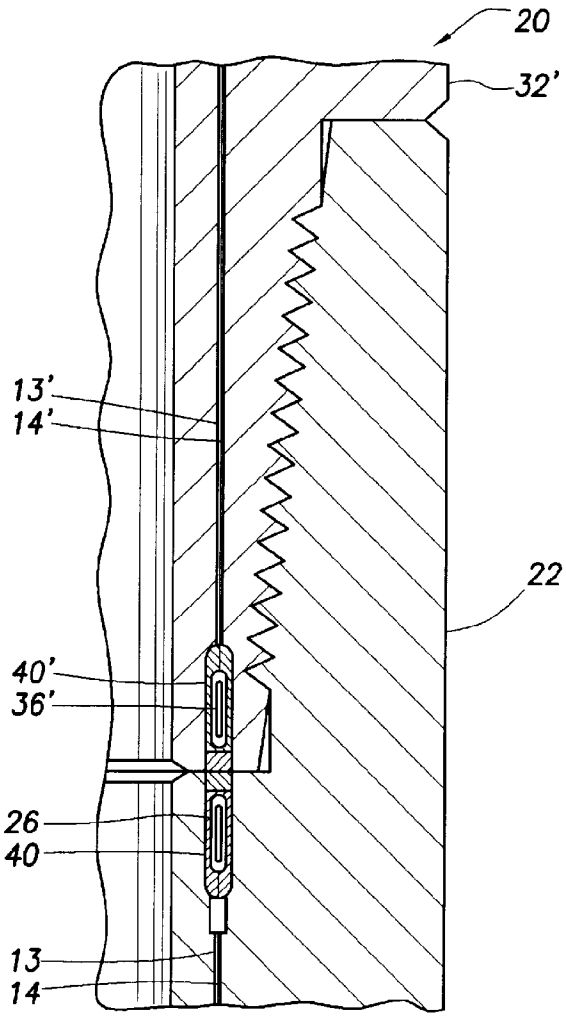
FIG. 4 is a cross-section view of a wired drill pipe joint.
Figure 3:
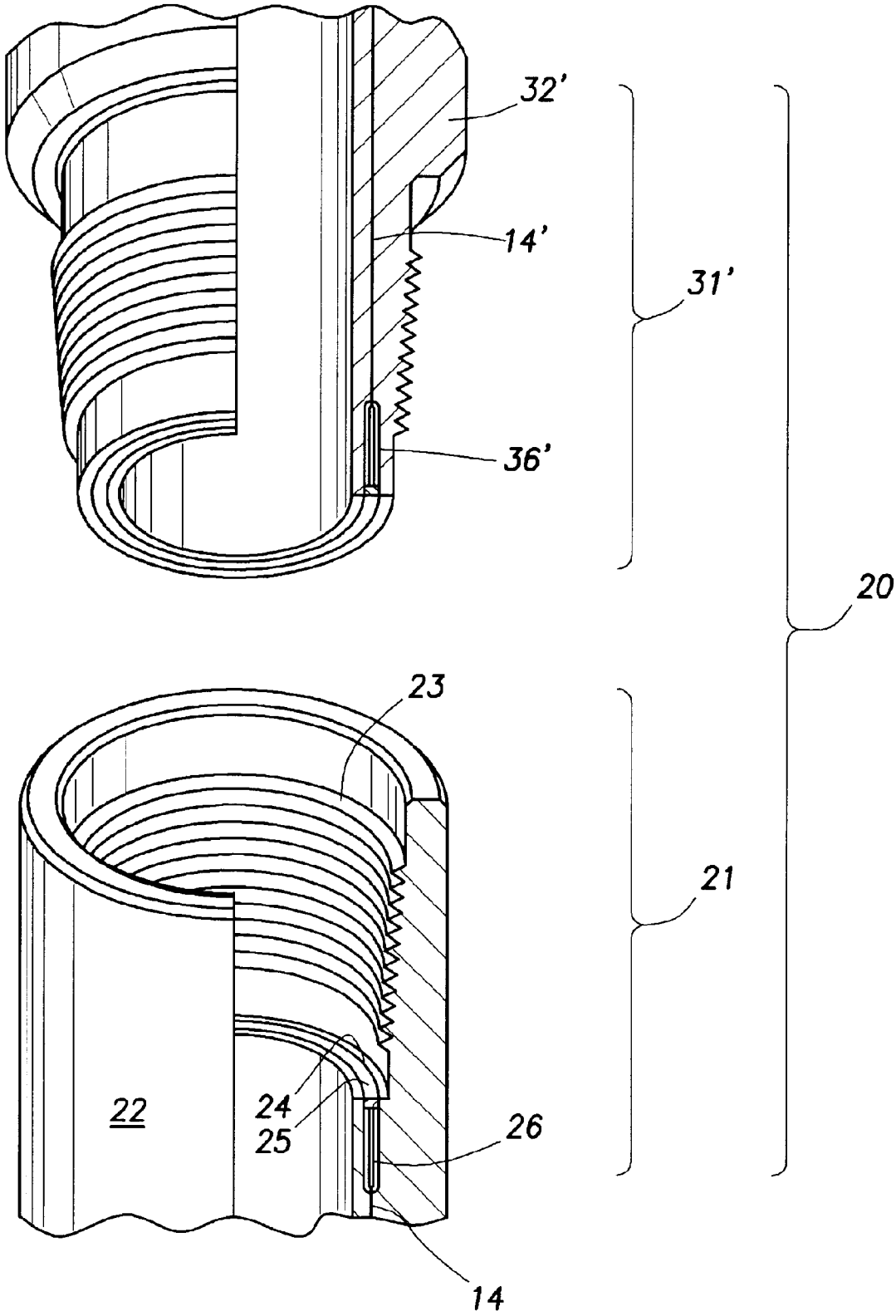
FIG. 3 shows a box and a pin connection of a wired drill pipe.

FIGS. 3 and 4 depict the inductive coupler 20 (or "telemetry connection") of FIG. 2 in greater detail. As shown in FIG. 3, box-end 22 includes internal threads 23 and an annular inner contacting shoulder 24 having a first slot 25, in which a first toroidal transformer 26 is disposed. The toroidal transformer 26 is connected to the wire 14. Similarly, pin-end 32" of an adjacent wired pipe includes external threads 33" and an annular inner contacting pipe end 34" having a second slot 35", in which a second toroidal transformer 36" is disposed. The second toroidal transformer 36" is connected to wire 14" of the adjacent pipe. The slots 25 and 35" may be clad with a suitable material (e.g., copper) to enhance the efficiency of the inductive coupling.

When the box end 22 of one WDP is assembled with the pin end 32" of the adjacent WDP, a pipe and or telemetry connection is formed. FIG. 4 shows a cross section of a portion of the joint, in which a facing pair of inductive coupler elements (i.e., toroidal transformers 26, 36") are locked together as part of an operational pipe string. This cross section view also shows that the closed toroidal paths 40 and 40" enclose the toroidal transformers 26 and 36", respectively, and conduits 13 and 13" form passages for internal electrical wires/cables 14 and 14" that connect the two inductive coupler elements disposed at the two ends of each WDP.

FIGS. 1–4 depict WDP Telemetry systems in which the present invention may be utilized. The inductive coupler depicted in FIGS. 2–4, incorporates an electric coupler made with a dual toroid. This dual-toroid coupler uses the inner shoulder of the pin and box as electrical contacts. The extreme pressures at these points after make-up help to assure the electrical continuity between the pin and the box. Currents are induced in the metal of the connection by means of toroidal transformers placed in grooves. At a given frequency (for example 100 kHz), these currents are confined to the surface of the grooves by skin depth effects. The pin and the box each constitute the secondary of a transformer, and the two secondaries are connected back to back via the mating surfaces.

Figure 5:
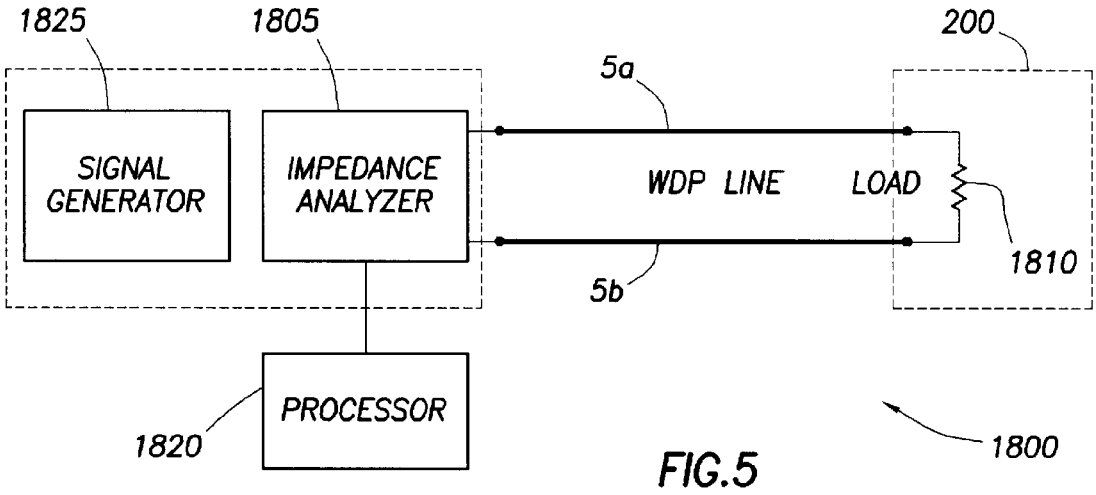
FIG. 5 is a schematic diagram of a fault diagnostic system for a WDP Telemetry system, the diagnostic system having an impedance analyzer.

FIG. 5 schematically depicts a system 1800 for diagnosing faults in a WDP Telemetry system, such as the system of FIGS. 1–4. The fault system 1800 includes an impedance analyzer 1805 operatively coupled to the communication link 5 extending through the WDPs (see FIG. 1). The communication link 5 comprises a pair of wires (5*a* and 5*b*) extending through the drill string and operatively coupled to a load 1810 generated by the BHA 200 of FIG. 1. Preferably, a processing unit (referred to herein as processor) 1820 is integral with or operatively connected to the impedance analyzer for analyzing the signals and making decisions based on the results. The processor may optionally be a computer.

The impedance analyzer preferably comprises a power supply, such as an AC source with variable frequency. The impedance analyzer may be a conventional electronics tool capable of taking measurements, such as impedance, voltage and/or current, of the WDP Telemetry system. The impedance analyzer may also include or be coupled to a signal generator 1825. The signal generator preferably produces a sinusoid whose frequency is swept across the range of interest to stimulate the device under test.

The impedance analyzer 1805 (alone or with the signal generator 1825) may be temporarily or permanently coupled to the WDP Telemetry system at various locations along the WDP communication link 5. The signal generator and/or impedance analyzer may be placed in one or more locations along the WDP Telemetry system as desired, such as in the WDP repeaters along the drill string (FIG. 1) or in separate test units (not shown).

While FIGS. 1–5 depict certain types of electrical systems, it will be appreciated by one of skill in the art that a variety of systems and/or configurations may be used. For example, such systems may involve magnetic couplers, such as those described in WO 02/06716 to Hall. Other systems and/or couplers are also envisioned.

Regardless of the system used, the inductance generated by the WDP telemetry system has similar properties. The inductance of each primary and the primary capacitance across the WDP Telemetry system constitute a parallel resonant circuit which has a resonant frequency ($f_1$) of:

$$f_1 = \frac{1}{2\pi\sqrt{L_{primary}C_{cable}}}$$

The leakage inductance and the primary capacitance constitute a parallel resonant circuit which has a resonant frequency ($f_2$) of:

$$f_1 \approx f_1\sqrt{\frac{L_{primary}}{2L_{coupling}}}$$

As more couplers are connected in series along the WDP telemetry system, additional resonances are inserted between the frequencies $f_1$ and $f_2$. Ultimately, when a very large number of couplers are connected in series, their resonances fill the band of frequencies $[f_1,f_2]$ and the impedance is nearly constant and resistive in this frequency band, while the power loss is optimum and almost flat versus frequency in this frequency band.

Figure 6A:
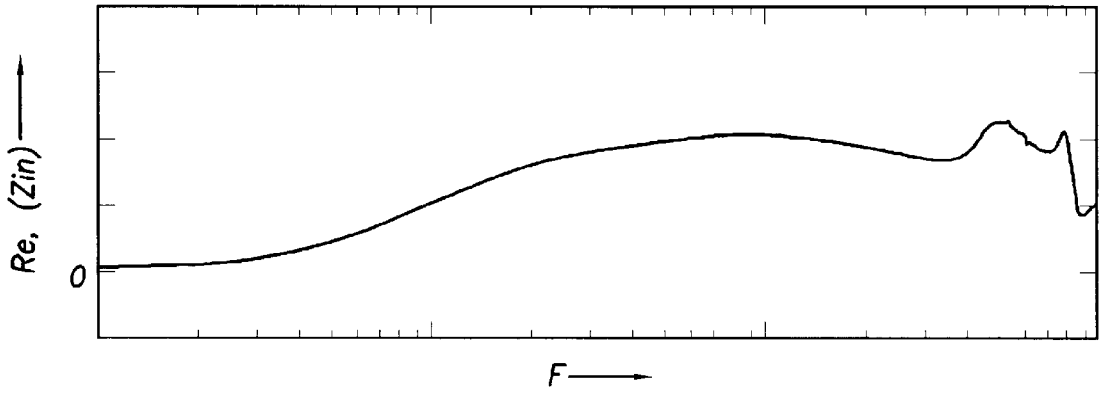
FIGS. 6A, 7A, 8A and 9A are graphical depictions of the real impedance as a function of frequency.
Figure 6B:
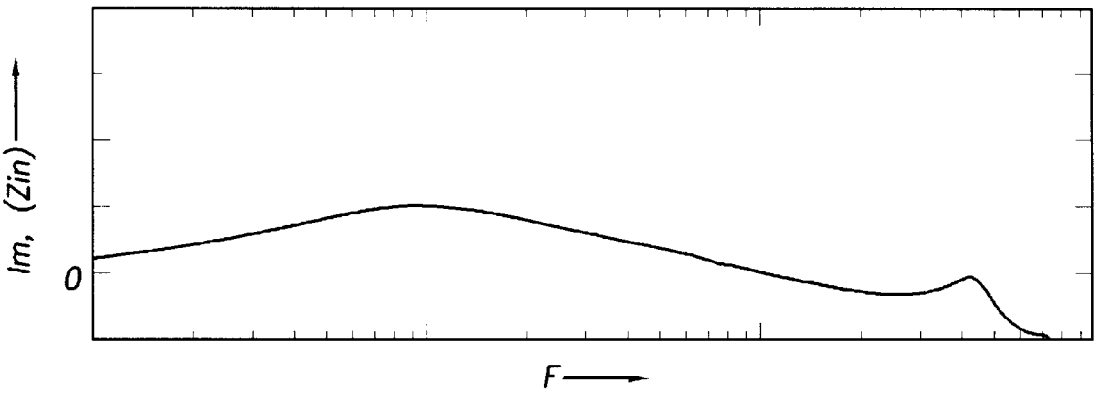
FIGS. 6B, 7B, 8B and 9B are graphical depictions of imaginary impedance.
Figure 7A:
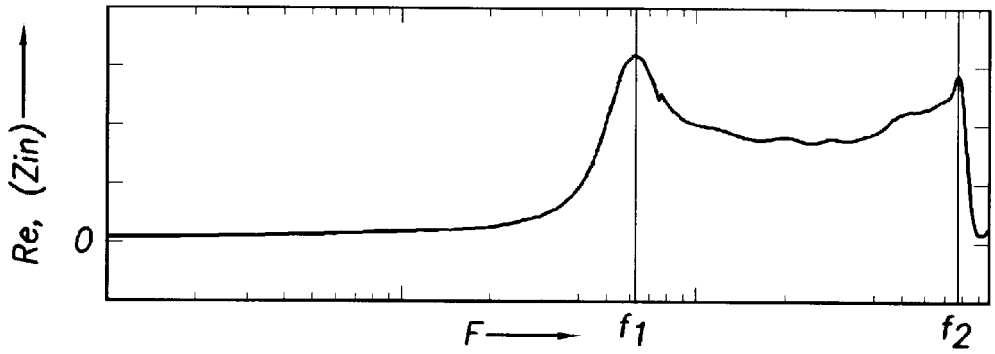
Figure 7B:
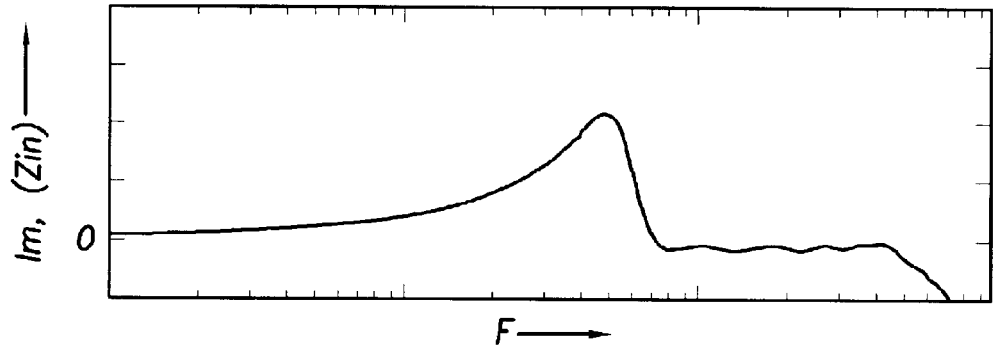
Figure 8A:
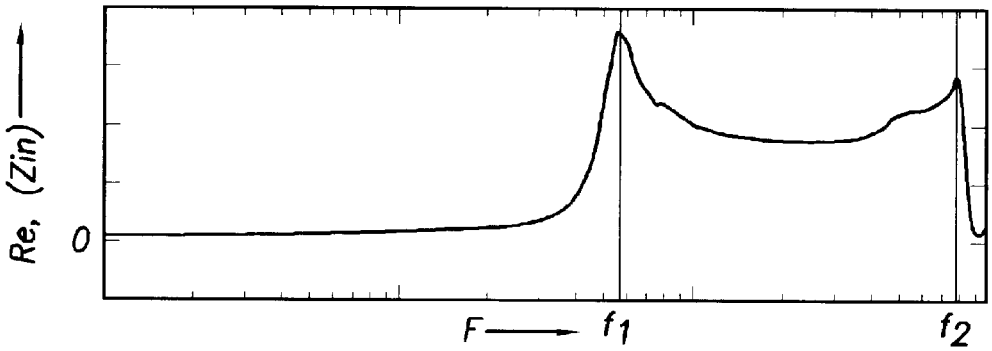
Figure 8B:
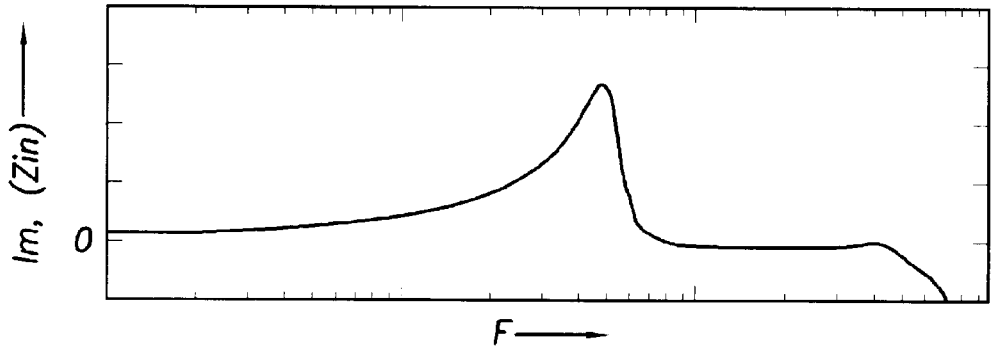
Figure 9A:
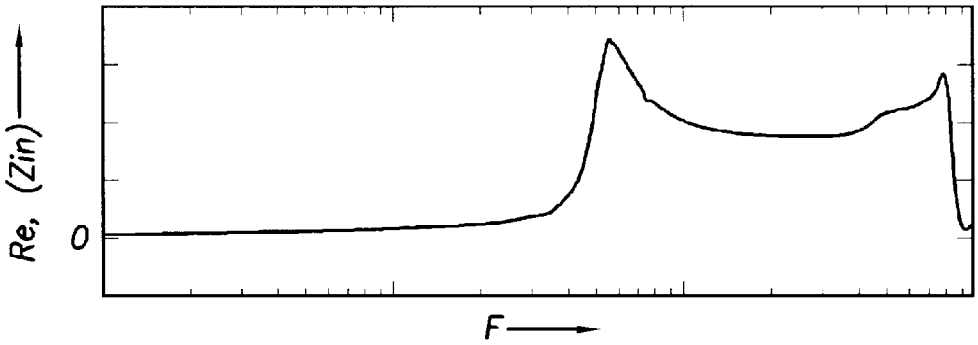
Figure 9B:
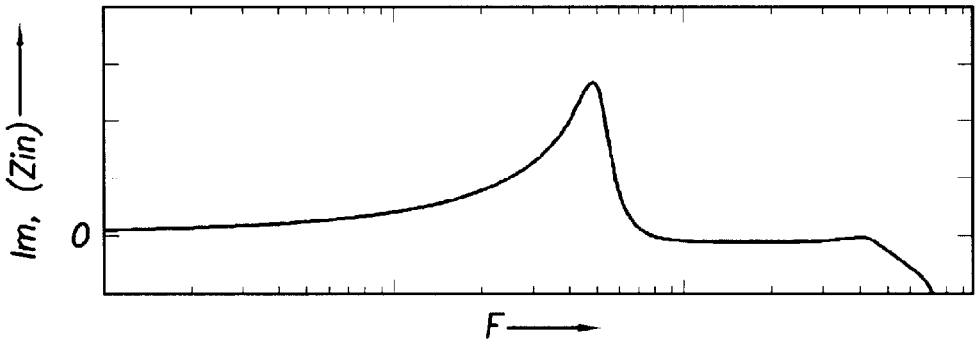
Figure 10A:
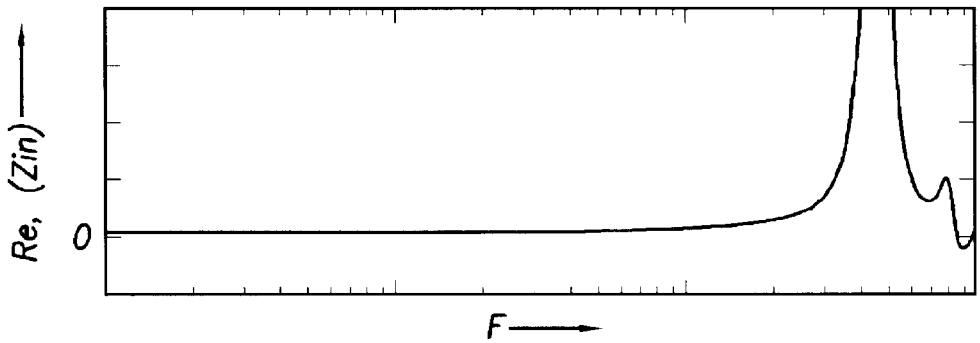
FIGS. 10A, 11A, 12A and 13A are graphical depictions of the real impedance as a function of frequency.
Figure 10B:
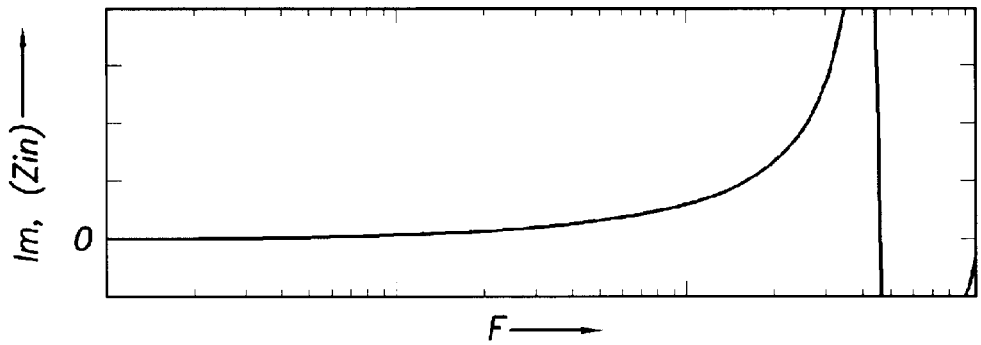
FIGS. 10B, 11B, 12B and 13B are graphical depictions of imaginary impedance.
Figure 11A:
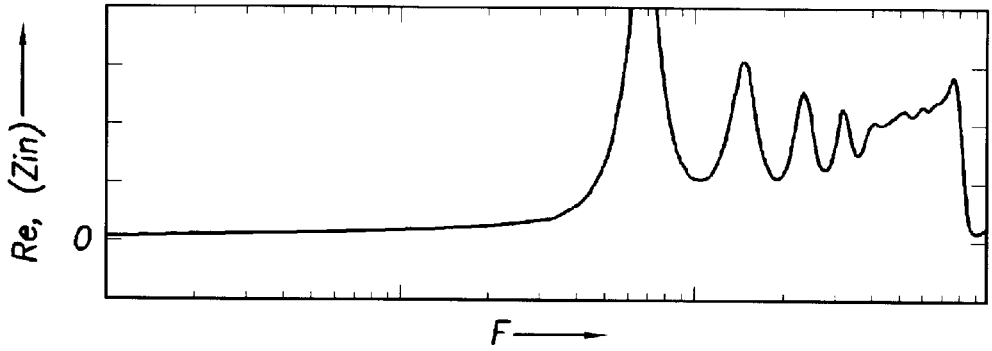
Figure 11B:
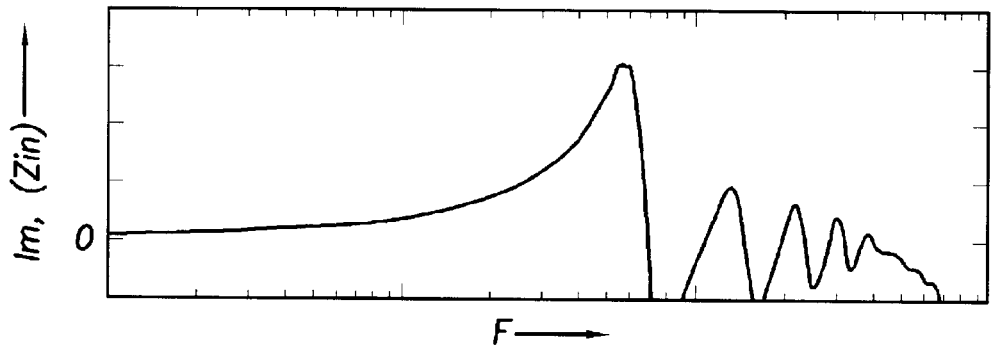
Figure 12A:
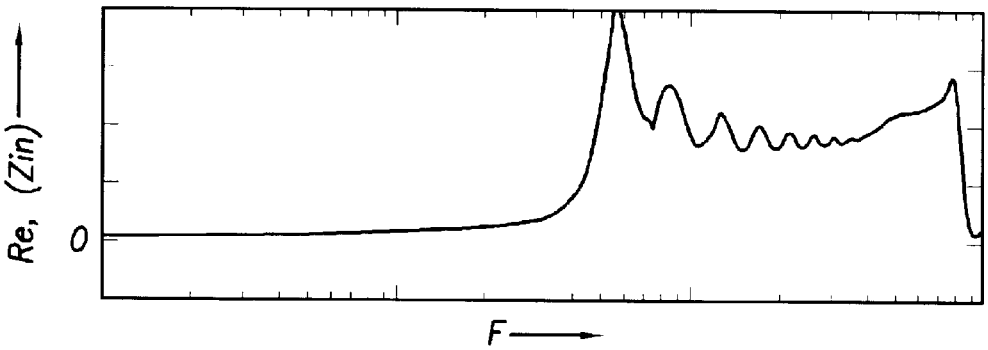
Figure 12B:
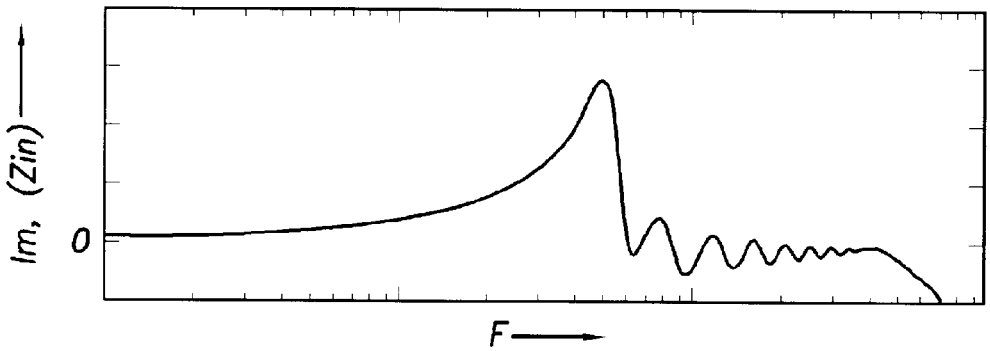
Figure 13A:
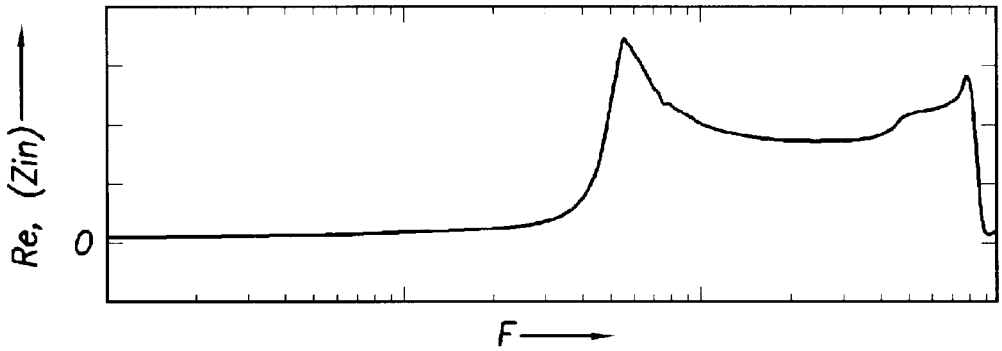
Figure 13B:
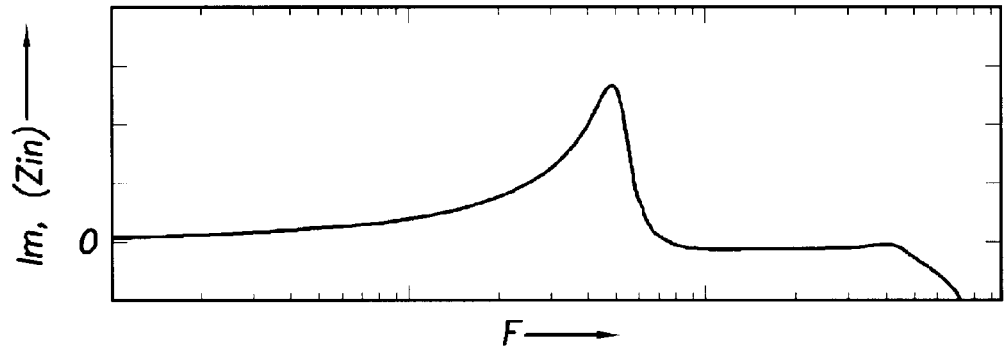
Figure 14A:
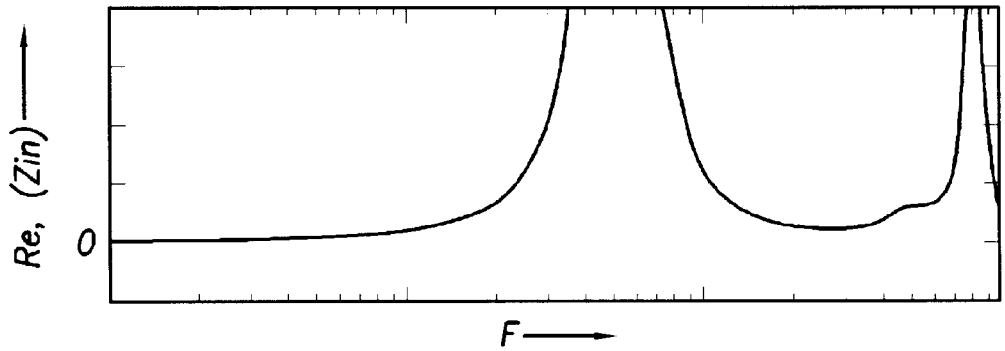
FIGS. 14A, 15A, 16A and 17A are graphical depictions of the real impedance as a function of frequency.
Figure 14B:
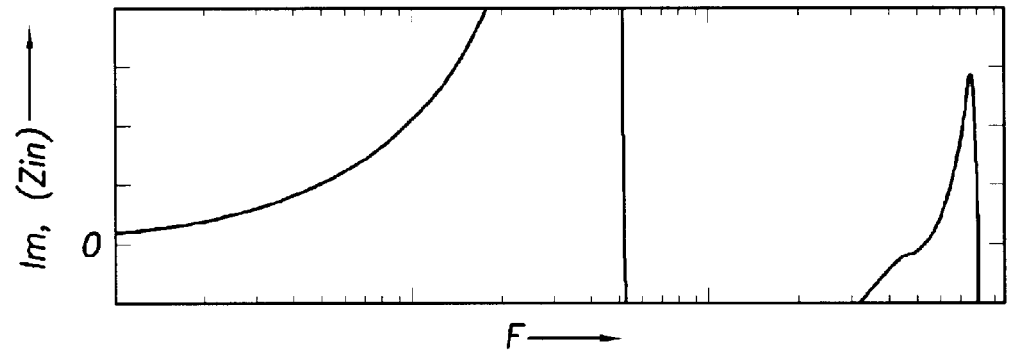
FIGS. 14B, 15B, 16B and 17B are graphical depictions of imaginary impedance.
Figure 15A:
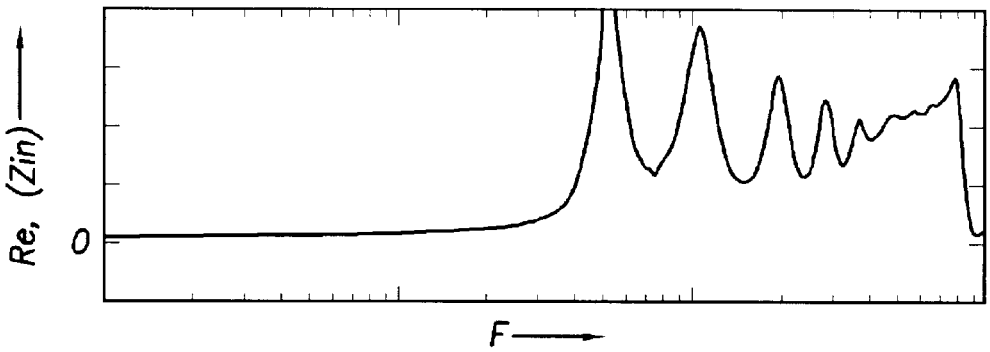
Figure 15B:
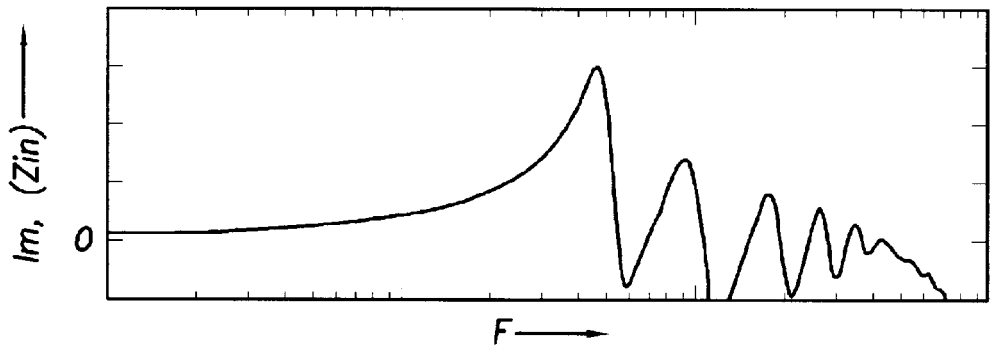
Figure 16A:
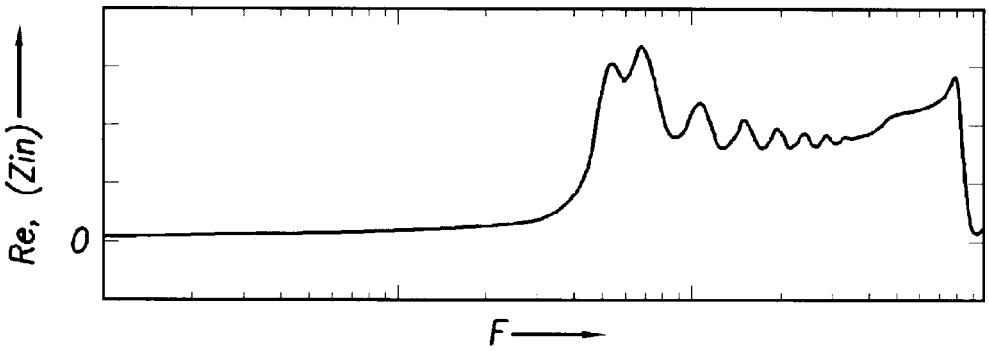
Figure 16B:
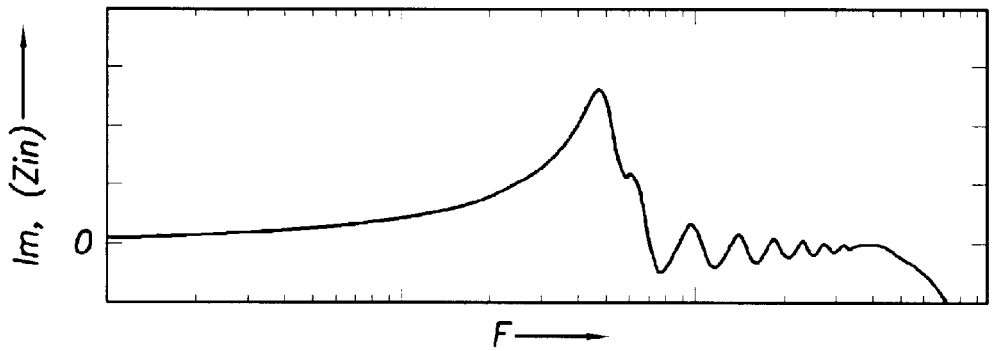
Figure 17A:
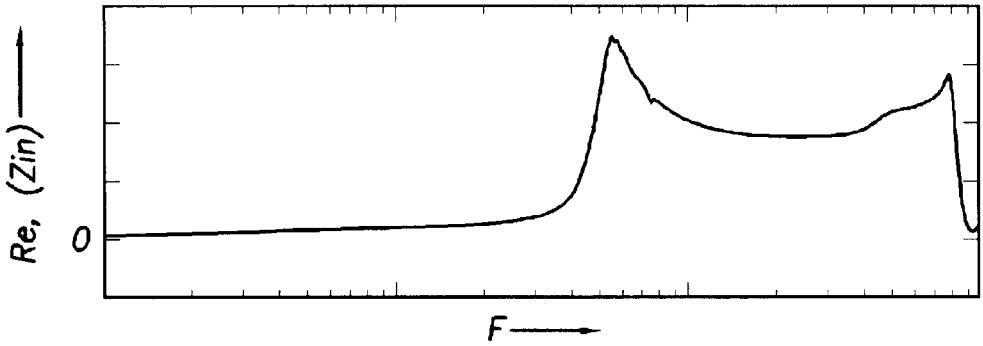
Figure 17B:
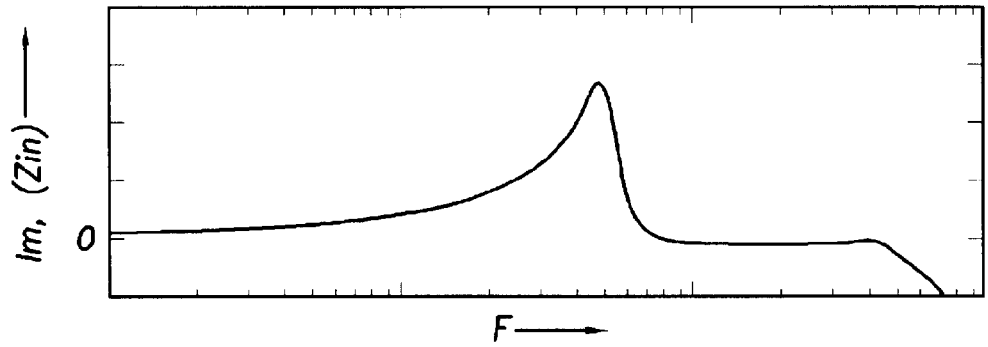

FIGS. 6 through 9 graphically demonstrate the above-described relationship between impedance and the number of couplers in a WDP Telemetry system. The curves may be generated using, for example, the systems of FIGS. 1–5. FIGS. 6 9 depict the normal impedance across a WDP Telemetry system (such as the WDP Telemetry system of FIGS. 1–6) having 2, 20, 40 and 100 WDP telemetry couplers, respectively. FIGS. 6A, 7A, 8A and 9A depict the real impedance versus frequency portions of a complex impedance produced by such systems. FIGS. 6B, 7B, 8B and 9B depict the imaginary impedance versus frequency portions of a complex impedance produced by such systems. Resonant frequencies ($f_1$, $f_2$) are depicted in FIGS. 7A and 8A.

FIGS. 10–13 are the same as those of FIGS. 6–9, except that each of the systems has at least one short therein. FIGS. 14–17 are the same as those of FIGS. 6–9, except that each of the systems is open (ie. has at least one broken wire therein). By comparing each of the Figures, it is possible to determine, for a given number of couplers, whether the system has a short, a break or is functioning properly.

These Figures further demonstrate that, when a large number of couplers (typically with about 100 or more couplers) are used, the impedance viewed at the end of the chain of pipes becomes independent of the load and is equal to the iterative impedance of the WDP. Typically, if there are less than about one hundred couplers, the line impedance depends strongly on the load. If there is an open or a short very close to the measurement point, the WDP line impedance will exhibit strong resonances at the $f_1$ and $f_2$ frequencies as shown for example in FIGS. 10, 11, 14 and 15. If there is an open or a short farther away from the measurement point (but less than about 100 couplers away), the WDP line impedance as a function of frequency will have multiple peaks or ripples between $f_1$ and $f_2$ as shown for example in FIGS. 12 and 16. If there are fewer couplers between the measurement point and the fault, there will be fewer peaks and they will have larger amplitudes. As the number of couplers increases, the number of peaks increases and their amplitudes decrease. See, for example, the differences between the lines depicted in FIGS. 11 and 12.

By analyzing the signal parameters, various characteristics of the WDP telemetry system may be determined. For example, if the WDP line impedance shows as function of frequency some ripple, then the fault is probably far from the source. Typically, the amplitude of the ripple is a function of the distance between the fault and the source. Where the WDP line impedance shows some strong resonances at the $f_1$ or $f_2$ frequencies, then the fault is close to the source. If the line impedance curve is equal to the iterative impedance, then the fault is probably not within the first 100 joints of Wired Drill Pipe.

A fault in a WDP telemetry link is diagnosed by measuring the impedance versus frequency, then comparing the measurement to predicted values for faults at different locations in the link. A family of reference curves with the predicted values may be developed for a given WDP Telemetry system. The type and location of a fault would be diagnosed by comparing the measured curves to the reference curves and determining which reference curve is most similar to the measured curve. Alternatively, a computer may be used to calculate the predicted values, compare the measured values to the predicted values and determine the best match between measured values and predicted values. Such measurements may be performed in real time or as desired. FIGS. 6 through 17 illustrate the typical behavior of a WDP telemetry link with inductive couplers. The exact behavior of any WDP telemetry link will depend on the particular characteristics of its components. Therefore, the reference curves or predicted values must be determined for a particular system using theoretical modeling and/or experimental measurements of that system.

Figure 18A:
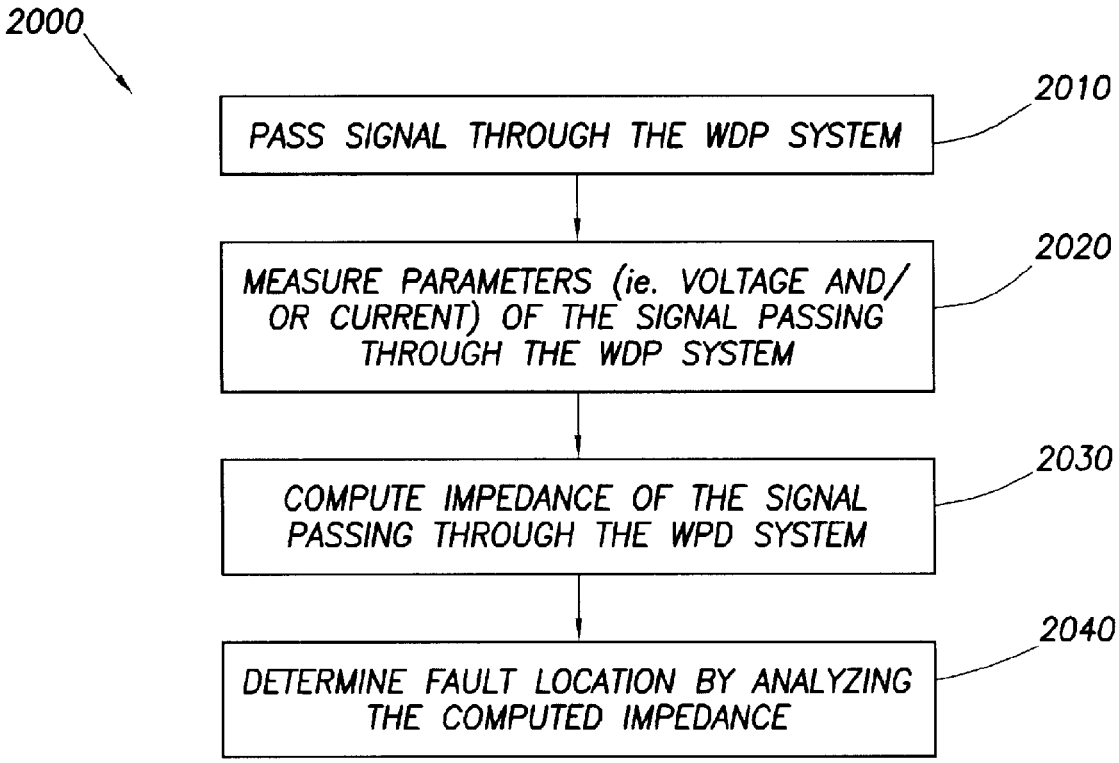
FIG. 18A is a block diagram depicting a method of identifying a fault using impedance.

Referring now to FIG. 18A, a method 2000 for identifying faults in a WDP Telemetry system, such as the systems of FIGS. 1–4, is described. The existence of a fault may be indicated by a lack of a telemetry signal or other evidence. To diagnose the fault, a signal is passed through the WDP Telemetry system (2010). The signal may be a frequency sweep or a series of discrete frequencies. This may be accomplished by having the signal generator 1825 (FIG. 5) send a signal through the WDP Telemetry system. The signal is measured as it passes through the WDP Telemetry system. The impedance analyzer may be used to measure parameters of the signal (2020), such as the line voltages and/or currents, of the communication link 5. The impedance on the WDP line may be computed from the measurements (2030). By analyzing the impedance (2040), the condition of the signal and/or location of a fault may be determined. The processor 1820 (FIG. 5) may be used to further process the data and/or the signal, compute the impedance, determine fault locations and/or provide other analysis.

The signal is typically analyzed by comparing the measured impedance against a known reference. Variations between the measured impedance and the known reference are indicators that a fault may occur as previously depicted in FIGS. 6–17 and described in relation thereto.

Figure 18B:
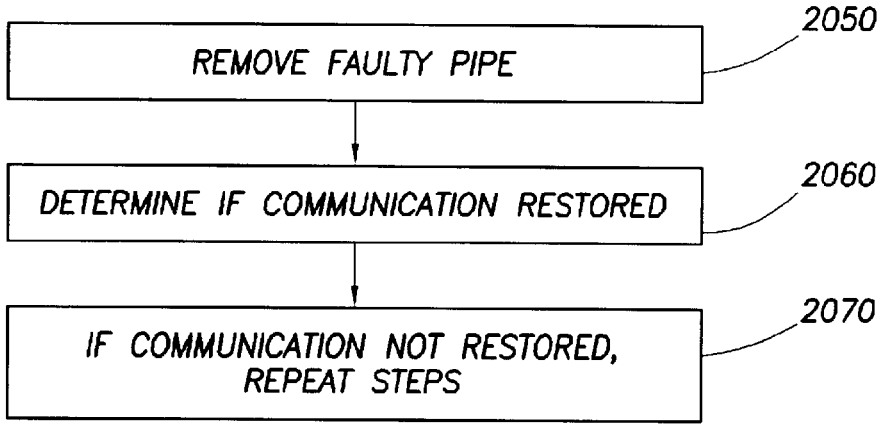
FIG. 18B is a block diagram of additional steps usable with the method of FIG. 18A.

FIG. 18B depicts additional steps that may be performed in accordance with the method of FIG. 18A. Once the location of a fault is determined, pipes forming the drill string may be removed to eliminate the faulty pipe (2050). As pipes are removed, the WDP telemetry system may be tested (2060) to determine if communication is restored. If the fault remains and/or until communication is restored, the method of FIGS. 18A and/or 18B may be repeated (2070).

If the measured impedance is found to be equal to the iterative impedance of the WDP, then the fault is probably more than about 100 couplers from the measurement point. If the measurements are made at the surface, then the next step in the diagnose procedure is to remove up to about 100 WDPs, then repeat the measurement and analysis process. If the fault is determined to be less than about 100 couplers from the measurement point, the next step is to estimate the position of the fault using the above procedure, remove fewer WDPs than the calculated number of couplers between the measurement point and the fault, then repeat the measurement and analysis process. When the fault is determined to be very close to the measurement point, then the WDPs are removed one by one and individually inspected or tested until the faulty WDP is found. Alternatively, a group of suspect WDPs may be removed for later inspection and repair. If normal communication can be established through the WDP telemetry system, the fault has been removed from the string and there are no more faults. If communication cannot be restored, there may be one or more additional faults within the telemetry link. The diagnosis procedure would be repeated to identify and remove the additional fault(s).

Figure 19:
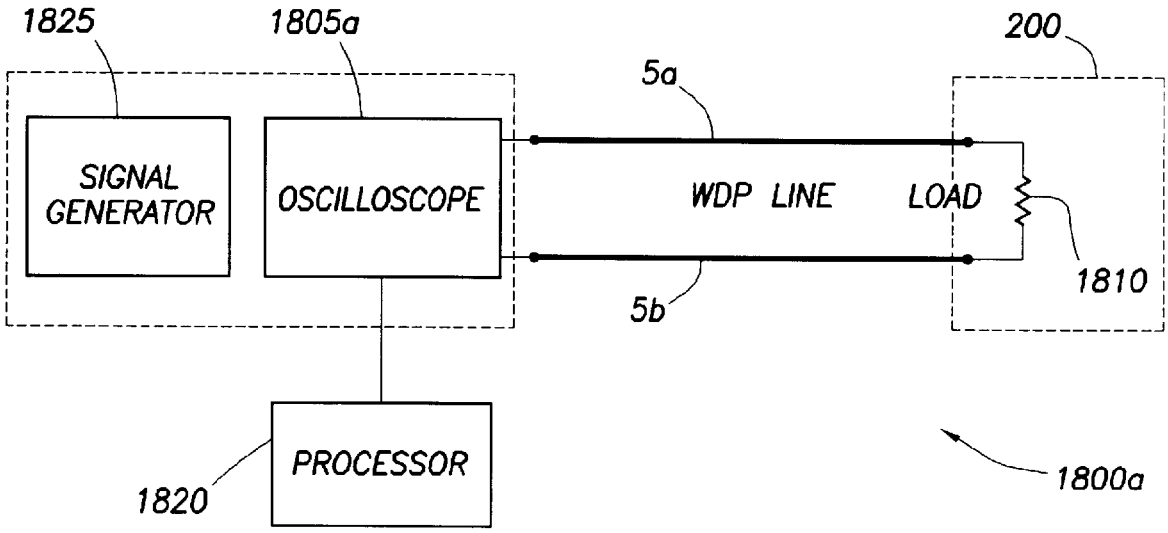
FIG. 19 is a schematic diagram of a fault diagnostic system for a WDP Telemetry system of FIG. 18, the diagnostic system having an oscilloscope.
Figure 20:
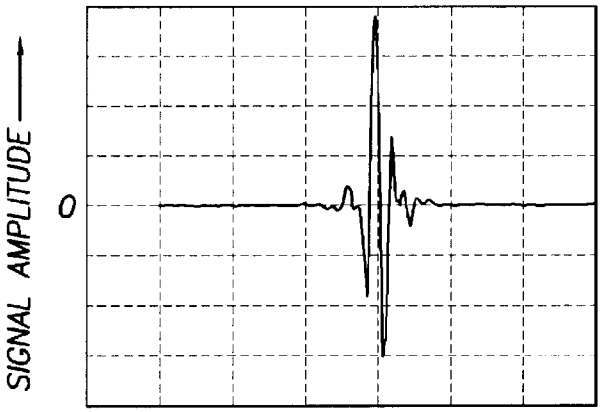
FIGS. 20, 21, 22 and 23 are graphical representations of signal amplitude versus time for the WDP telemetry system of FIG. 28 depicting a pulse and reflected pulse taken on the time domain having 2, 20, 40 and 100 couplers, respectively.
Figure 21:
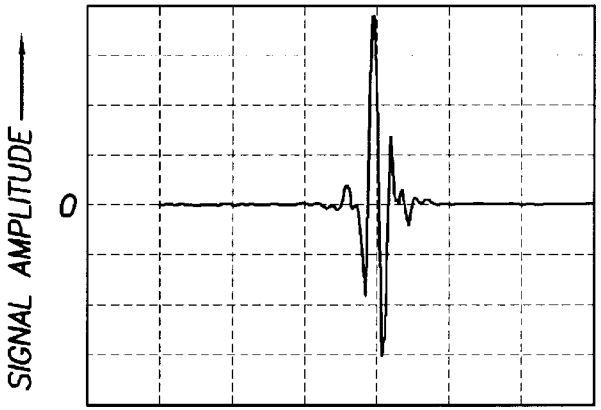
Figure 22:
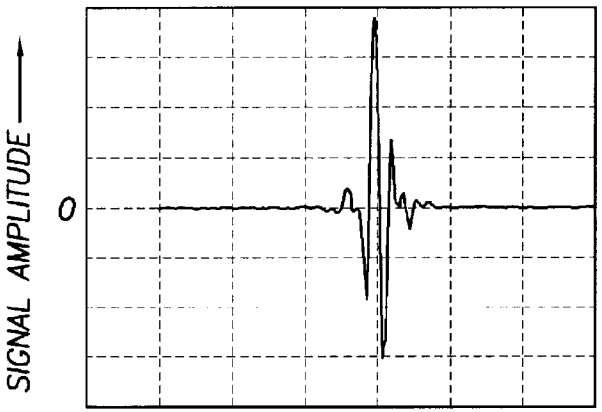
Figure 23:
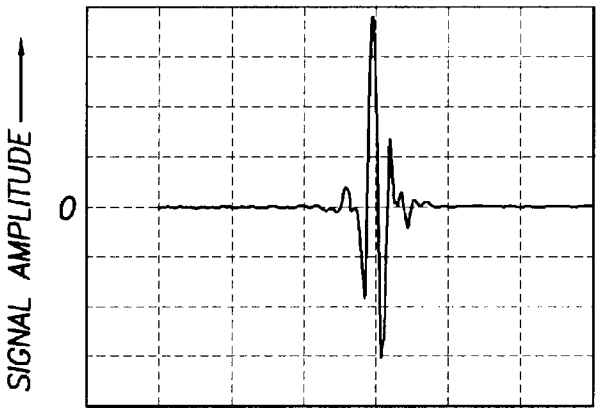

FIG. 19 depicts an alternate configuration of a system 1800*a* for identifying faults in a WDP Telemetry system. The fault system 1800*a* of FIG. 19 is the same as the fault system 1800 of FIG. 5, except that system 1800*a* uses an oscilloscope 1805*a* in place of the impedance analyzer 1805. The combination of the oscilloscope and the signal generator may be any conventional electronics tool, such as a Time Domain Reflectometry (TDR) box, capable of transmitting a waveform and receiving a reflected waveform, along the communication link 5. The TDR Box sends a signal through the WDP Telemetry system and receives a signal therefrom. The TDR Box measures the signal for various parameters, such as time delay. The processor 1820 may be used to detect faults and/or provide other analysis.

FIGS. 20, 21, 22 and 23 graphically demonstrate the normal transmission of a pulse through the WDP telemetry system without a reflection. These curves may be generated using, for example, the systems of FIGS. 1–4 and 19. The curves depict voltage, or signal amplitude, as a function of time. The transmitted pulse (in this case, a square root raised cosine) and the reflected signal (if any) are shown in each curve. Each of the systems is normally terminated (i.e., terminated by an impedance equal to the iterative impedance of the WDP, typically about 100 ohms to 400 ohms or so) at 2, 20, 40 and 100 WDP telemetry couplers from the source respectively. These Figures show only the transmitted pulse, demonstrating that, when there is no fault present in any normally terminated string of WDP, no reflections will appear.

Figure 24:
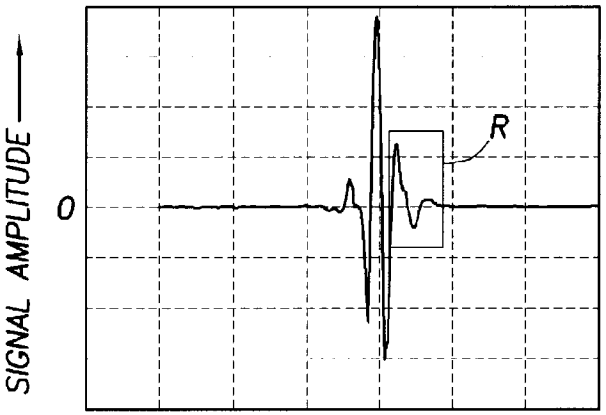
FIGS. 24, 25, 26 and 27 are graphical depictions of the pulses of FIGS. 21, 22, 23 and 24, respectively, with an open fault.
Figure 25:
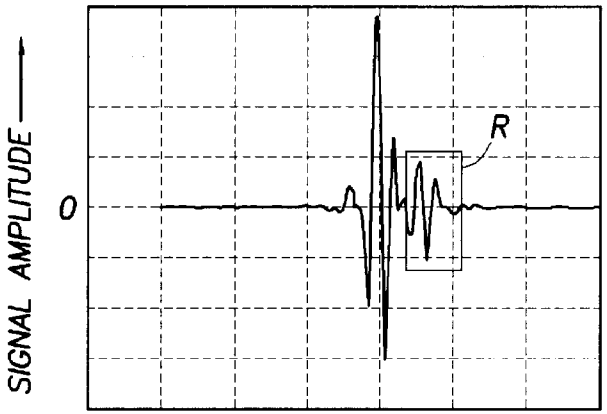
Figure 26:
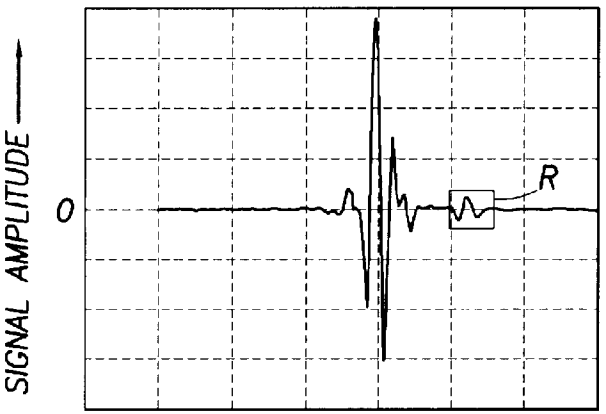
Figure 27:
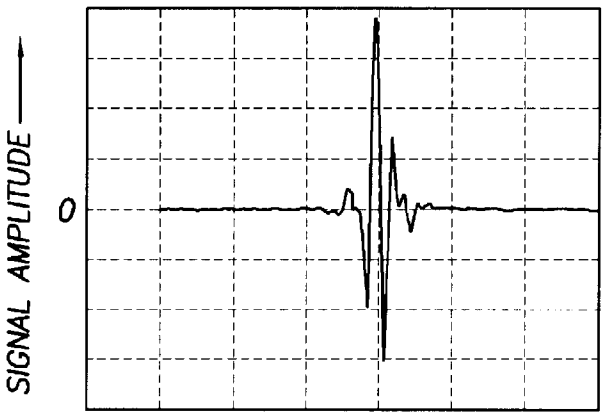

FIGS. 24, 25, 26 and 27 are the same as the TDR curves of FIGS. 20–23, except that each has an open therein. In FIG. 24, the reflected pulse arrives so quickly that it overlaps the transmitted pulse and creates a reflection R. In FIGS. 25 and 26 the reflections are distinct from the transmitted pulse, with progressively later arrival times and lower amplitudes as the number of intervening couplers increases. FIG. 27 has no reflection. The fault is essentially invisible because it is more than about 100 WDP telemetry coupler away.

Figure 29:
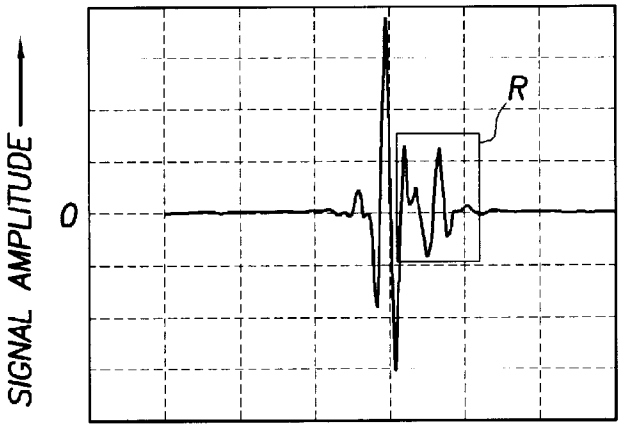
FIGS. 28, 29, 30 and 31 are the pulses of FIGS. 21, 22, 23 and 24, respectively, with a short.
Figure 28:
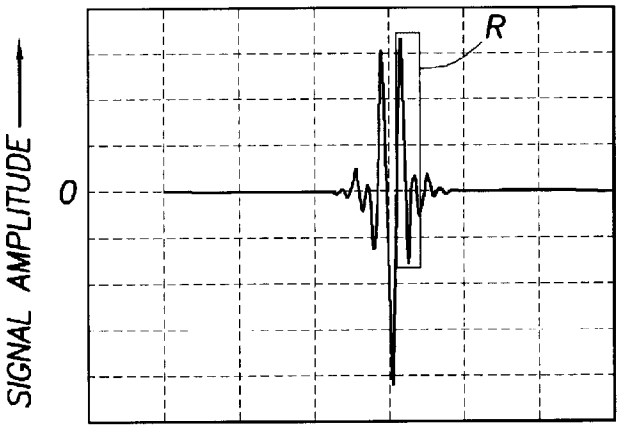
Figure 31:
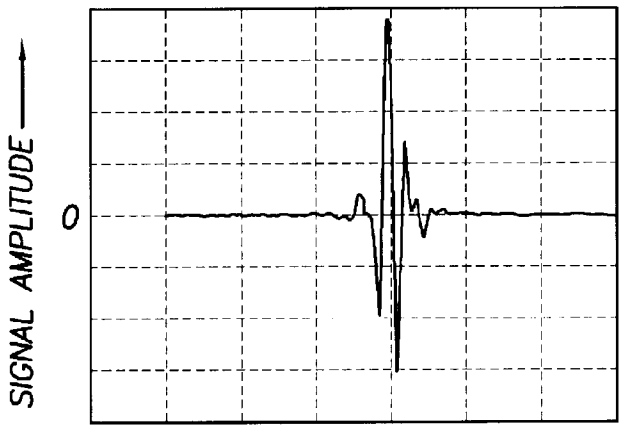
Figure 30:
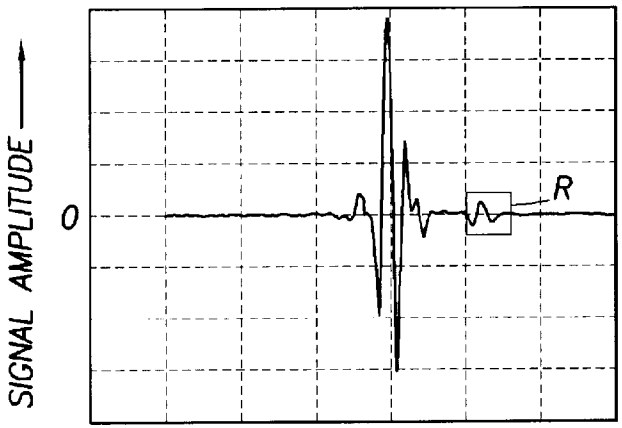

FIGS. 28, 29, 30 and 31 are the same as those of FIGS. 20–23, except that each of the systems has at least one short therein. Like the TDR curves of FIGS. 24–27, the curves of FIGS. 28–30 have a reflection R. In FIG. 28, as with FIG. 24, the reflection overlaps with the transmitted pulse. In FIGS. 29 and 30, the reflections are distinct with progressively later arrivals and lower amplitudes. FIG. 31, like FIG. 27 has no reflection because the fault is more than about one hundred (100) couplers away.

In all three curves, the reflections are inverted, or have an opposite polarity or phase, when compared to FIGS. 24–26. Consequently, it is possible to distinguish whether a fault is an open or short by examining the polarity of the reflected signal. By comparing each of the Figures, it is possible to determine, for a given number of couplers less than about 100, whether the system has a short, a break or is functioning properly. The delay and the characteristic impedance are typically analyzed using an echo technique to reveal, at a glance, the characteristic impedance of the line. Additionally, this echo technique shows both the position and the nature (resistive, inductive, or capacitive) of the fault. By determining the time delay, the number of couplers and the distance traveled may be determined. The processor 1820 (FIG. 19) may be used to manipulate and/or analyze the signal. For example, the processor may be used to calculate the reflection delay, amplitude and polarity, compare the calculated values to the predicted values for different fault types and locations and determine the best match between calculated values and predicted values.

Figure 32A:
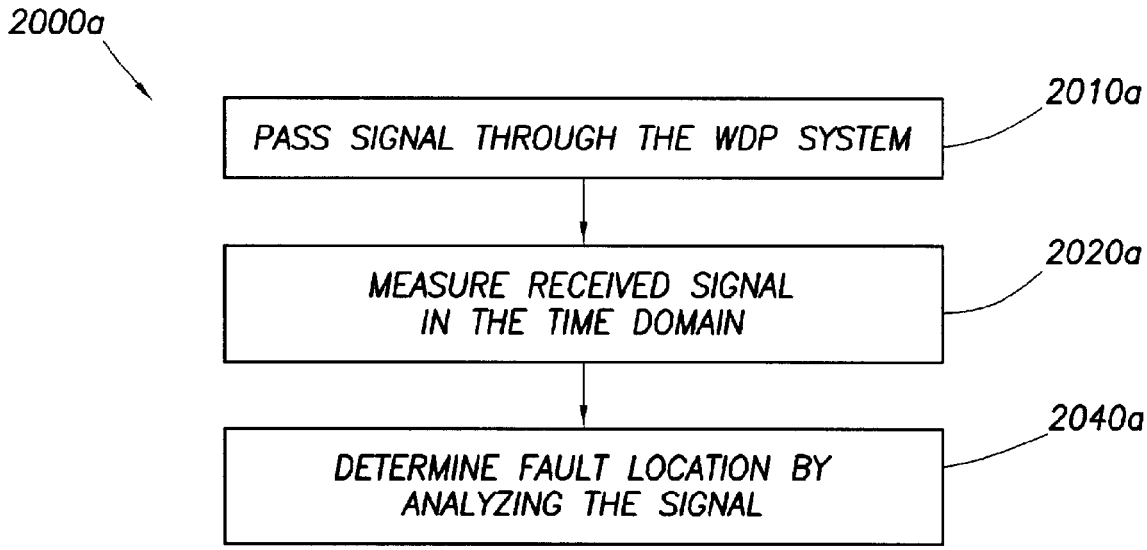
FIG. 32A is a block diagram depicting an alternate method of identifying a fault using Time Delay Reflectometry (TDR).

FIG. 32A depicts an alternate method 2000*a* of determining faults in a WDP telemetry system. A signal is passed through the WDP telemetry system (2010*a*). This signal generator 1825 (FIG. 19) may be used to generate the necessary signal, preferably a fast pulse is launched into the transmission line under investigation. A variety of pulse shapes may be used, such as a rectangle pulse shape, square root raised cosine (SRRC) or other pulse shapes. The signal received back through the WDP telemetry system is measured (2020*a*). The incident and reflected voltage waves may be measured and/or monitored using the TDR box 1805*a* (FIG. 19). By analyzing the signal the fault location may be determined (2030*a*).

Figure 32B:
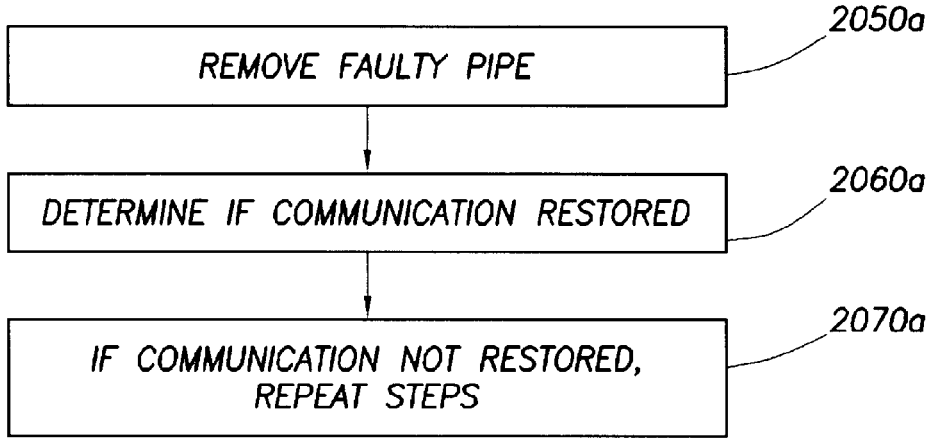
FIG. 32B is a block diagram of additional steps usable with the method of FIG. 32A.

FIG. 32B depicts additional steps that may be performed in accordance with the method of FIG. 32A. Once the location of a fault is determined, pipes forming the drill string may be removed to eliminate the faulty pipe (2050*a*). As pipes are removed, the system may be tested (2060*a*) to determine if communication is restored. If the fault remains and/or until communication is restored, the method of FIGS. 32A and/or 32B may be repeated (2070*a*).

The impedance method 2000 and the TDR method 2000*a* may be used as desired to diagnose faults. One system may be more applicable to a given situation than another, depending on the nature of the fault being diagnosed and the characteristics of the measurement apparatus being used. The impedance method tends to be more sensitive to faults that are close to the measurement point, while the TDR method may receive some overlap in signals when the fault is very close. The TDR method may be more deterministic for faults at medium distances. Combining the two systems and corresponding methods can increase the reliability and accuracy of the diagnosis. These systems and methods may also be used in conjunction with other known analytical tools.

While the invention has been described with respect to a limited number of embodiments, those skilled in the art, having benefit of this disclosure, will appreciate that other embodiments can be devised which do not depart from the scope of the invention as disclosed herein. For example, the impedance analyzer of FIG. 5 may be used in conjunction with the TDR Box of FIG. 19 to enable the simultaneous and/or alternating operation of the fault diagnosis systems 1800 and 1800*a*. Accordingly, the scope of the invention should be limited only by the attached claims.

What is claimed is:

1. A method for performing diagnostics on a wired drill pipe telemetry system of a downhole drilling system, comprising:

a) passing a signal through a plurality of drill pipe in the wired drill pipe telemetry system;

b) receiving the signal from the wired drill pipe telemetry system;

c) measuring parameters of the received signal; and d) comparing the received signal parameters against a known reference for variation thereof whereby a fault in the wired drill pipe telemetry system is identified.

2. The method of claim 1 wherein one of the location, type, existence and combinations thereof of the fault is identified.

3. The method of claim 1 wherein the signal is a waveform.

4. The method of claim 3 wherein the signal is one of sinusoid, sweep, and combinations thereof.

5. The method of claim 1 wherein the step of measuring comprises measuring one of the voltage, the current and combinations thereof of the received signal.

6. The method of claim 5 further comprising determining the impedance of the received signal.

7. The method of claim 6 wherein step c) comprises comparing the determined impedance against a known reference to identify at least one resonance therein whereby a fault in the wired drill pipe telemetry system is identified.

8. The method of claim 7 further comprising determining the location of the fault by comparing the determined impedance with an iterative impedance of the known reference.

9. The method of claim 1 wherein the signal is a pulse.

10. The method of claim 1 wherein the received signal is received a time delay after passing the signal.

11. The method of claim 10 wherein step b) comprises measuring one of the time delay, the amplitude, phase and combinations thereof of the received signal.

12. The method of claim 10 wherein step c) comprises comparing characteristics of the time delay of the received signal against the time delay of a known reference to identify a reflection therein whereby the fault is identified.

13. The method of claim 1 further comprising removing at least one of the plurality of wired drill pipe and repeating steps a) d).

14. A method for performing diagnostics on a wired drill pipe telemetry system of a downhole drilling system having a plurality of wired drill pipes, comprising the following steps:

passing a signal through the wired drill pipe telemetry system;

receiving the signal from the wired drill pipe telemetry system;

measuring one of a voltage, a current and combination thereof of the received signal;

determining the impedance of the received signal; and comparing the impedance of the received signal with the impedance of a known reference to identify a variation therefrom whereby a fault in the wired drill pipe telemetry system is identified.

15. The method of claim 14 wherein one of the location, type, existence and combinations thereof of the fault is identified.

16. The method of claim 14 wherein the signal is a waveform.

17. The method of claim 16 wherein the signal is one of sinusoid, sweep and combinations thereof.

18. The method of claim 14 further comprising removing at least one of the plurality of wired drill pipe and repeating the steps.

19. A method for performing diagnostics on a wired drill pipe telemetry system of a downhole drilling system having a plurality of wired drill pipe, comprising the following steps:

passing a signal through the wired drill pipe telemetry system;

receiving the signal from the wired drill pipe telemetry system, the signal received a time delay after the signal is passed;

determining the time delay of the received signal; and comparing the time delay of the received signal against the time delay of a known reference to identify a variation therefrom whereby a fault in the wired drill pipe telemetry system is identified.

20. The method of claim 18 wherein the signal is a pulse.

21. The method of claim 18 wherein the variation is a reflection.

22. The method of claim 18 further comprising removing at least one of the plurality of wired drill pipe and repeating the steps.

23. A system for performing diagnostics on a wired drill pipe telemetry system of a downhole drilling system, the wired drill pipe comprising a communication link, comprising:

a signal generator operatively connectable to the communication link of the wired drill pipe telemetry system, the signal generator capable of passing a signal through the communication link;

a gauge operatively connectable to the communication link, the gauge capable of receiving the signal from the wired drill pipe telemetry system and taking a measurement thereof; and a processor capable of comparing the received signal with a know reference to identify variations therefrom whereby a fault in the wired drill pipe telemetry system is detected.

24. The apparatus of claim 23 wherein the signal generator is integral with the gauge.

25. The apparatus of claim 23 wherein the gauge is one of an impedance analyzer, an oscilloscope and combinations thereof.

26. The apparatus of claim 23 wherein the apparatus is removably connectable to the wired drill pipe telemetry system.

27. The apparatus of claim 23 wherein the apparatus is incorporated into the wired drill pipe telemetry system.

28. The apparatus of claim 23 wherein the signal generator is capable of generating one of a sinusoid, a pulse and combinations thereof.

* * * * *